US008696366B2

(12) United States Patent
Chen et al.

(10) Patent No.: US 8,696,366 B2
(45) Date of Patent: Apr. 15, 2014

(54) CONNECTOR MODULE HAVING A MALE CONNECTOR AND A FEMALE CONNECTOR EACH HAVING A MAGNETIC PART, A CATHODE CONTACT AND AN ANODE CONTACT

(75) Inventors: Chien-Chuan Chen, Taipei (TW); Kun-Huang Hsu, Taipei (TW); Chia-Wei Chang, Taipei (TW)

(73) Assignee: Inhon International Co. Ltd., Taipei (TW)

( * ) Notice: Subject to any disclaimer, the term of this patent is extended or adjusted under 35 U.S.C. 154(b) by 28 days.

(21) Appl. No.: 13/612,358

(22) Filed: Sep. 12, 2012

(65) Prior Publication Data

US 2013/0260577 A1 Oct. 3, 2013

(30) Foreign Application Priority Data

Apr. 3, 2012 (TW) ..... 101206079 A

(51) Int. Cl.
*H01R 11/30* (2006.01)

(52) U.S. Cl.
USPC ..... 439/39

(58) Field of Classification Search
USPC ..... 439/38–40
See application file for complete search history.

(56) References Cited

U.S. PATENT DOCUMENTS

| | | | | |
|---|---|---|---|---|
| 7,637,746 | B2 * | 12/2009 | Lindberg et al. | 439/38 |
| 7,771,202 | B2 * | 8/2010 | Amotz et al. | 439/39 |
| 7,967,627 | B2 * | 6/2011 | Limpkin et al. | 439/314 |
| 7,980,888 | B1 * | 7/2011 | Fukushima | 439/489 |
| 8,414,306 | B2 * | 4/2013 | Tagawa et al. | 439/63 |
| 2012/0329532 | A1 * | 12/2012 | Ko | 455/573 |

* cited by examiner

*Primary Examiner* — Chandrika Prasad
(74) *Attorney, Agent, or Firm* — Morris Manning & Martin LLP; Tim Tingkang Xia, Esq.

(57) ABSTRACT

A connector module includes a female connector and a male connector. The female connector includes a female magnetic part having a jack, an anode contact disposed in the jack, and a cathode contact disposed on the female magnetic part and surrounding the jack. The male connector includes a male magnetic part corresponding to the female magnetic part, an anode plug protruded from the male magnetic part, and a cathode plug disposed on the male magnetic part having a protruding position and an invaginating position in relative to the male magnetic part. When the male magnetic part attracts the female magnetic part, the anode plug is inserted in the jack and is in electrical contact with the anode contact. The cathode plug is in electrical contact with the cathode contact and is moved from the protruding position to the invaginating position. The male connector rotates on the female connector relatively.

20 Claims, 4 Drawing Sheets

CONNECTOR MODULE HAVING A MALE CONNECTOR AND A FEMALE CONNECTOR EACH HAVING A MAGNETIC PART, A CATHODE CONTACT AND AN ANODE CONTACT

CROSS-REFERENCE TO RELATED APPLICATIONS

This non-provisional application claims priority under 35 U.S.C. §119(a) on Patent Application No(s). 101206079 filed in Taiwan, R.O.C. on Apr. 3, 2012, the entire contents of which are hereby incorporated by reference.

BACKGROUND

1. Technical Field

The present disclosure relates to a connector module, and more particularly to a connector module having a male connector pivoting on a female connector relatively.

2. Related Art

Lately, manufacturing technologies of electronic products are improved with development of information technology. In addition to a compact design, the electronic products are also developed towards superior performance.

Take tablet computer as an example, the thickness of the tablet computer is thinner than that of a general laptop computer so that it is much more convenient for a user to carry the tablet computer with himself/herself. Furthermore, the tablet computer has a built-in battery, and the tablet computer must include a power cord so that the tablet computer may be charged by the user. Moreover, when the tablet computer is turned on, power is supplied with the power cord via a power socket. In this way, it may avoid power wasting in the built-in battery of the tablet computer.

However, the power cord of the tablet computer known to the inventor is that a male connector of the power cord is in a long-rectangular shape and a female connector of the tablet computer is a long-rectangular trough as well. Therefore, when the user inserts the male connector of the power cord into the female connector of the tablet computer, the male connector only has two angles of plug-in directions (0 degree and 180 degrees). In this way, the current structural design of the male connector and the female connector is inconvenient for the user to operate the tablet computer.

SUMMARY

An embodiment discloses a connector module, comprising a female connector and a male connector. The female connector comprises a female magnetic part, an anode contact, a cathode contact. The female magnetic part has a jack. The anode contact is disposed in the jack. The cathode contact is disposed on the female magnetic part and surrounds the jack. The male connector comprises a male magnetic part, an anode plug and at least one cathode plug. The male magnetic part corresponds to the female magnetic part. The anode plug is disposed on and protruded from the male magnetic part. The at least one cathode plug is disposed on the male magnetic part. The at least one cathode plug removably has a protruding position and an invaginating position in relative to the male magnetic part. When the male magnetic part attracts the female magnetic part, the anode plug is inserted into the jack and in electrical contact with the anode contact. The at least one cathode plug is in electrical contact with the cathode contact and the at least one cathode plug moves from the protruding position to the invaginating position. The male connector is used for rotating on the female connector relatively.

Another embodiment discloses a female connector for pivoting on a male connector comprising a male magnetic part, an anode plug and a cathode plug. The female connector comprises a female magnetic part, an anode contact and a cathode contact. The female magnetic part corresponds to the male magnetic part and has a jack. The anode contact is disposed in the jack and corresponds to the anode plug. The cathode contact is disposed on the female magnetic part. The cathode contact surrounds the jack and corresponds to the cathode plug.

Yet another embodiment discloses a male connector for pivoting on a female connector comprising a female magnetic part, an anode contact and a cathode contact. The male connector comprises a male magnetic part, an anode plug, and at least one cathode plug. The male magnetic part corresponds to the female magnetic part. The anode plug is disposed on and protruded from the male magnetic part and corresponds to the anode contact. The at least one cathode plug is disposed on the male magnetic part. The at least one cathode plug removably has a protruding position and an invaginating position in relative to the male magnetic part. The at least one cathode plug corresponds to the cathode contact.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

The detailed features and advantages of the disclosure are described below in great detail through the following embodiments, the content of the detailed description is sufficient for those skilled in the art to understand the technical content of the present disclosure and to implement the disclosure hereof. Based upon the content of the specification, the claims, and the drawings, those skilled in the art can easily understand the relevant objectives and advantages of the disclosure.

Figure 1:
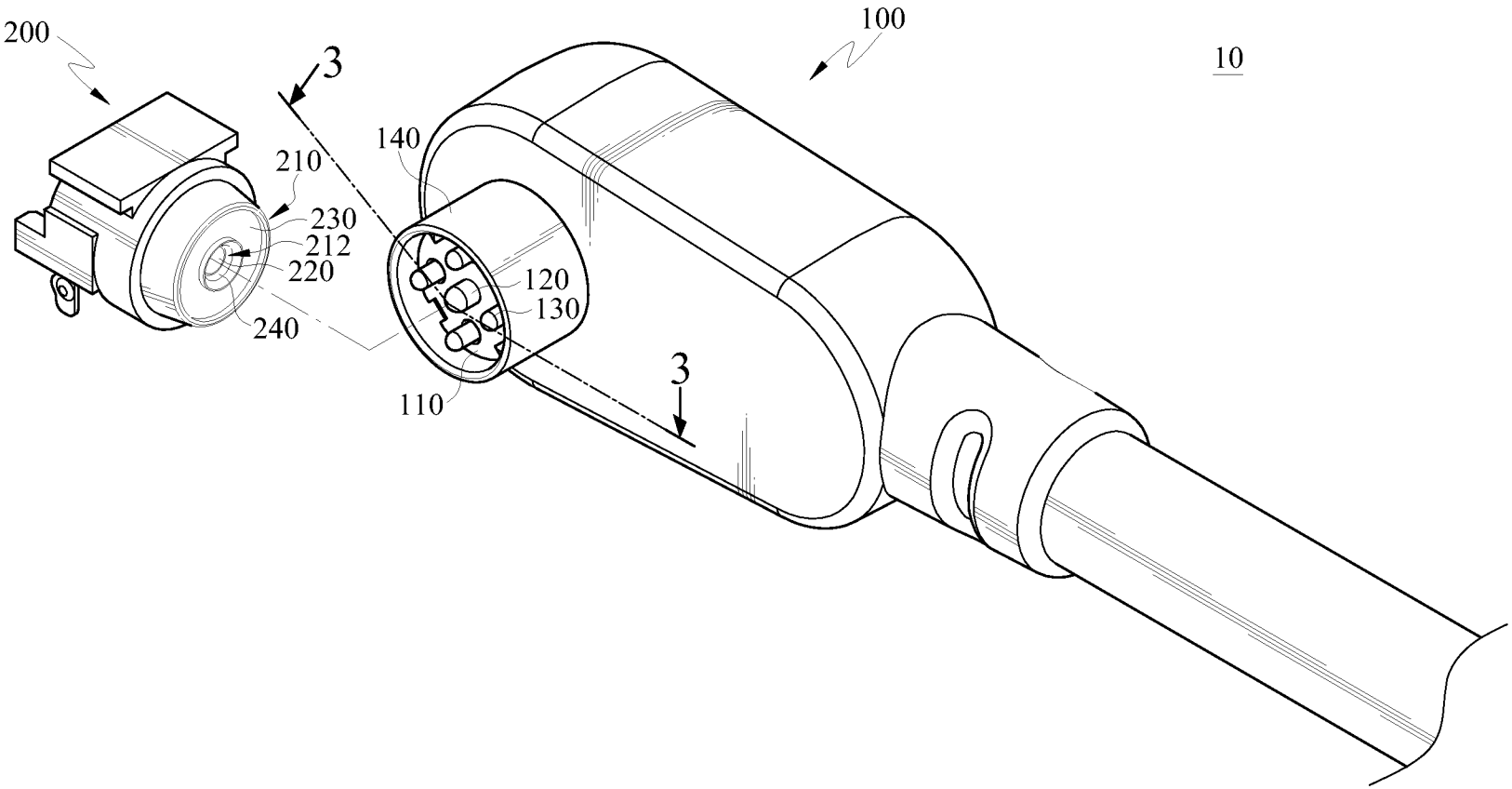
FIG. 1 is a schematic view of a connector module according to an embodiment.
Figure 2:
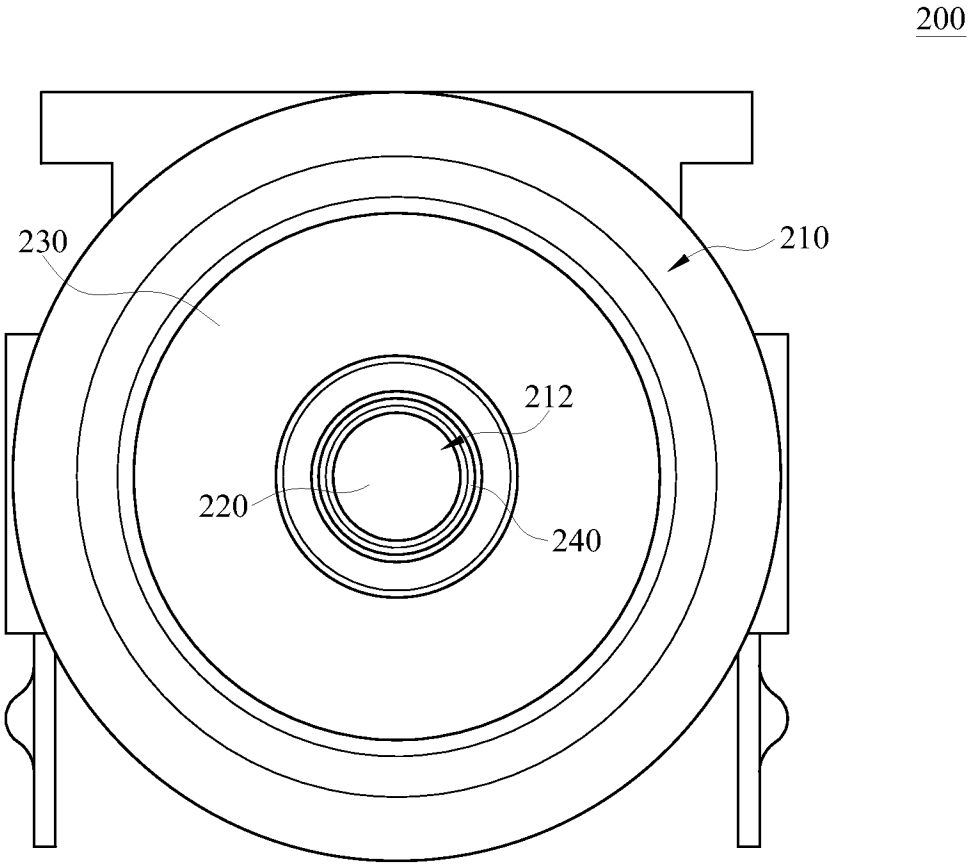
FIG. 2 is a front view of a female connector according to an embodiment.
Figure 3:
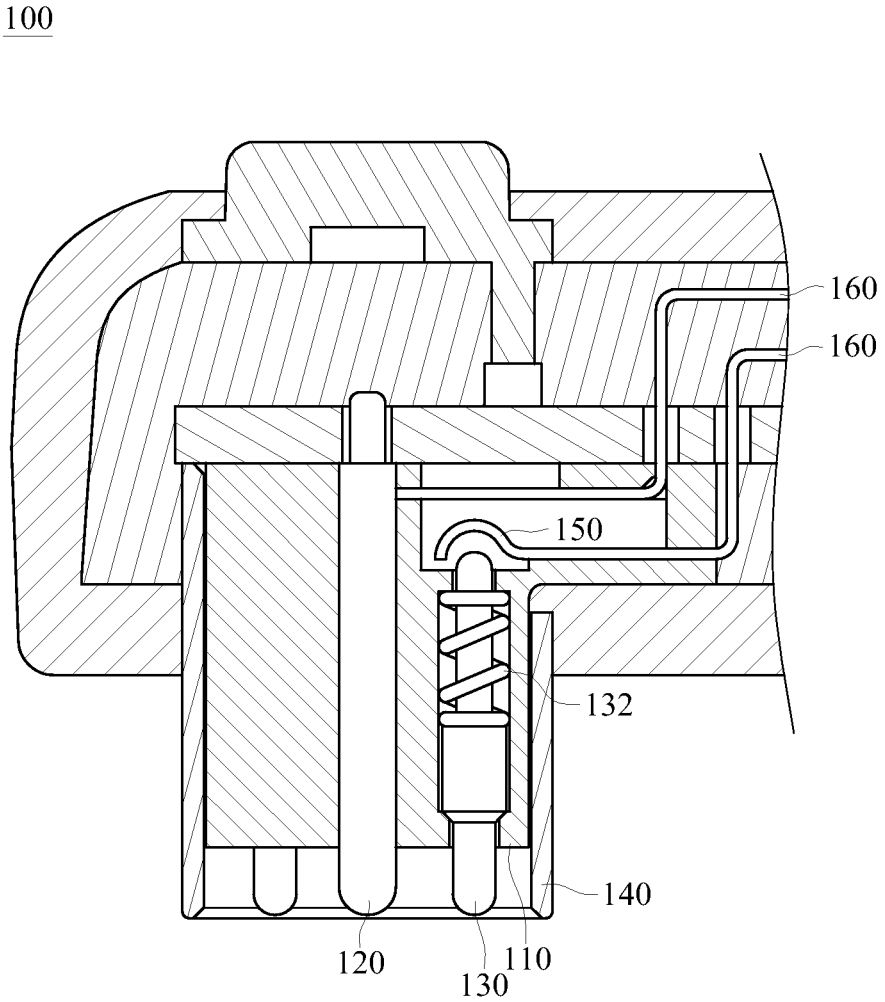
FIG. 3 is a cutaway view of a male connector along line 3-3 in FIG. 1 according to an embodiment.

Please refer to FIG. 1, FIG. 2 and FIG. 3. FIG. 1 is a schematic view of a connector module according to an embodiment, FIG. 2 is a front view of a female connector according to an embodiment, and FIG. 3 is a cutaway view of a male connector along line 3-3 in FIG. 1 according to an embodiment.

A connector module 10 according to this embodiment is applicable to an example of a power socket of a laptop computer and a plug of a power cord, but is not limited to the embodiment.

The connector module 10 comprises a female connector 200 and a male connector 100. The female connector 200 may be the above-mentioned power socket of the tablet computer and the male connector 100 may be the above-mentioned plug of the power cord, but not limited to the embodiment.

The female connector 200 comprises a female magnetic part 210, an anode contact 220 and a cathode contact 230.

The shape of the female magnetic part 210 is about a circular column projection. The material of the female magnetic part 210 may be a permanent magnet or a magnetic conductive material. The magnetic conductive material may be selected from the group consisting of iron, cobalt, nickel or a combination thereof, but not limited to the above-mentioned material. The female magnetic part 210 has a jack 212 which may be disposed at the center of the female magnetic part 210.

The anode contact 220 is disposed in the jack 212. The cathode contact 230 is disposed on the female magnetic part 210, and the cathode contact 230 surrounds the jack 212.

Furthermore, the female magnetic part 210 further comprises an insulated layer 240 which surrounds the jack 212. Besides, the insulated layer 240 is disposed between the anode contact 220 and the cathode contact 230. The anode contact 220 and the cathode contact 230 are electrically insulated from each other by the insulated layer 240, so the short-cut problem due to the electrical contact generated by the assembly tolerance of the anode contact 220 and the cathode contact 230 is avoided. In addition, the anode contact 220, the insulated layer 240 and the cathode contact 230 are arranged to one another in a concentric circular way, as shown in FIG. 2.

The male connector 100 comprises a male magnetic part 110, an anode plug 120 and at least one cathode plug 130.

The male magnetic part 110 corresponds to the female magnetic part 210. When the material of the female magnetic part 210 is the permanent magnet, the material of the male magnetic part 110 may be the permanent magnet or the magnetic conductive material. When the material of the female magnetic part 210 is the magnetic conductive material, the material of the male magnetic part 110 is the permanent magnet. That is to say, the material of the male magnetic part 110 matches with that of the female magnetic part 210 to each other, so that the male magnetic part 110 and the female magnetic part 210 may be attracted to each other because of the magnetic attractive force.

The anode plug 120 is approximately disposed at the center of the male magnetic part 110, and the anode plug 120 is protruded from the male magnetic part 110. The anode plug 120 corresponds to the anode contact 220.

Figure 4:
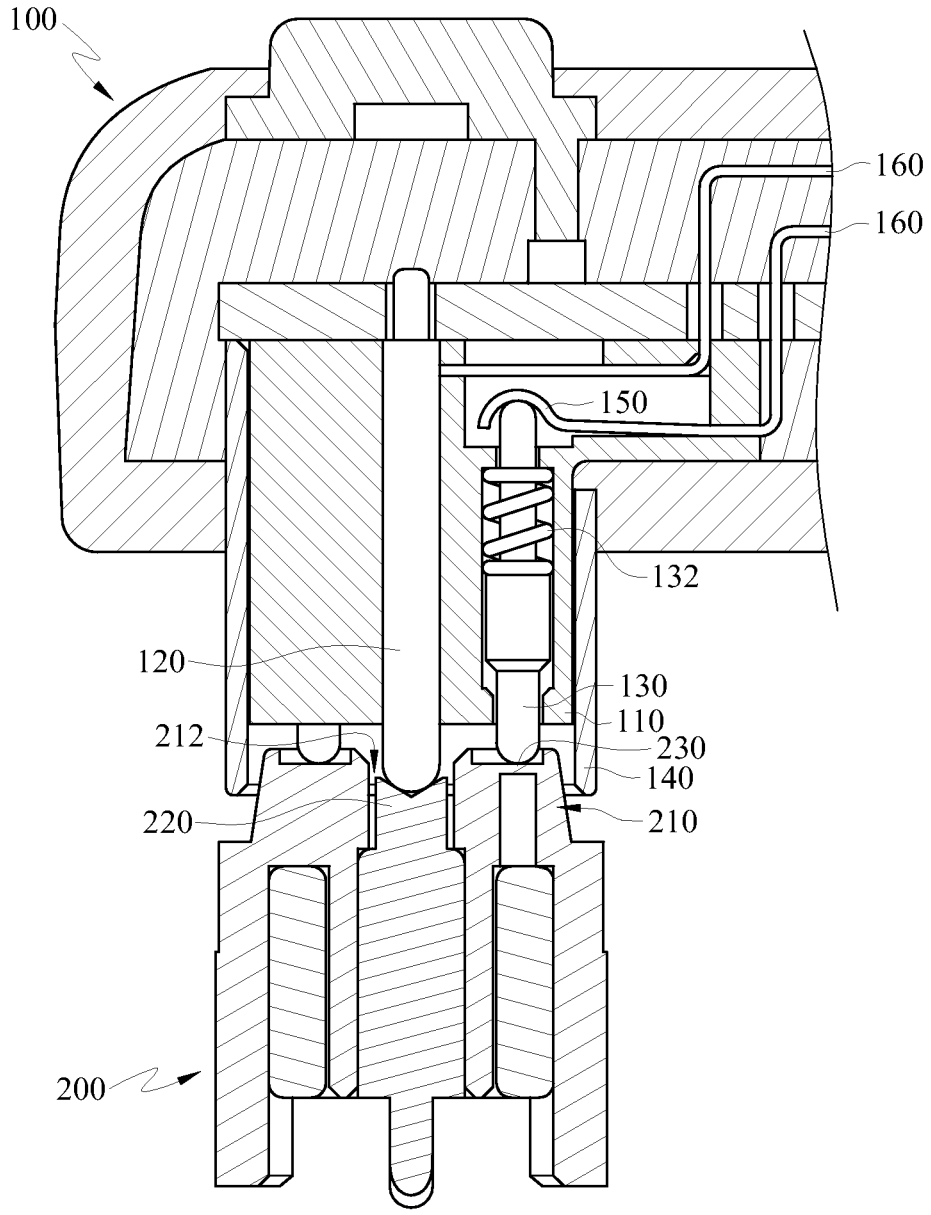
FIG. 4 is a cutaway view of a combination of a male connector and a female connector according to an embodiment.

Please refer to FIGS. 1 to 4. FIG. 4 is a cutaway view of a combination of a male connector and a female connector according to an embodiment. The cathode plugs 130 are disposed on the male magnetic part 110. In this embodiment, the amount of the cathode plugs 130 is four, but is not limited to the embodiment. For example, in some embodiment, the amount of the cathode plugs 130 may be three, two, one or more than four. Besides, the four cathode plugs 130 surround the anode plug 120. Moreover, each of the cathode plugs 130 may removably have a protruding position (as shown in FIG. 3) and an invaginating position (as shown in FIG. 4). When being at the protruding position, the cathode plug 130 is protruded from the male magnetic part 110. When being at the invaginating position, the cathode plug 130 is invaginated toward the male magnetic part 110. Furthermore, a springy element 132 is disposed in the male magnetic part 110. The springy element 132 may be a compressed sponge. The springy element 132 provides a pushing force so that the cathode plug 130 is kept at the protruding position still.

In addition, in some embodiments, an elastic element 150 and two power cords 160 are disposed in the male connector 100. One of the power cords 160 is electrically connected to the anode plug 120, and the other one of the power cords 160 is electrically connected to the elastic element 150. Furthermore, when one of the cathode plugs 130 is at the protruding position, an end of the one cathode plug 130 in the male magnetic part 110 is kept a distance from the elastic element 150 (as shown in FIG. 3). When the one cathode plug 130 is pressed by an external force and moved from the protruding position to the invaginating position, and the one cathode plug 130 is in electrical contact with the elastic element 150 (as shown in FIG. 4).

In addition, in some embodiments, the male connector 100 further comprises a ring-shaped sidewall 140. The ring-shaped sidewall 140 surrounds and covers the male magnetic part 110. Also, the height that the ring-shaped sidewall 140 protrudes from the male magnetic part 110 is greater than or equal to the other heights that the anode plug 120 and the cathode plugs 130 protrude from the male magnetic part 110. In this way, the ring-shaped sidewall 140 may prevent the anode plug 120 and the cathode plugs 130 from the bending due to the collision by any external object.

In addition, the shape of the ring-shaped sidewall 140 matches with the circular-column-projection shape of the female magnetic part 210. When the male magnetic part 110 attracts the female magnetic part 210, the ring-shaped sidewall 140 surrounds and covers the female connector 200 for providing the positioning when the male connector 100 is inserted in the female connector 200.

Please continuously refer to FIG. 4, when a user inserts the male connector 100 in the female connector 200, the male connector 100 attracts and attaches to the female connector 200 by the magnetic attractive force, and the ring-shaped sidewall 140 surrounds and covers the female magnetic part 210. Furthermore, the anode plug 120 is inserted in the jack 212 on the female magnetic part 210 so the anode plug 120 is in electrical contact with the anode contact 220. At this time, the cathode plugs 130 are in electrical contact with the cathode contact 230 as well. The cathode plugs 130 are pressed by the female magnetic part 210 and invaginated from the protruding position to the invaginating position, so an end of the cathode plugs 130 in the male magnetic part 110 is in electrical contact with the elastic element 150. In this way, a conducted electrical circuit may be formed.

That is to say, in this embodiment, because the cathode plugs 130 are pressed by the female magnetic part 210, the cathode plugs 130 are invaginated to the invaginating position to be in electrical contact with the elastic element 150 for ensuring that only when the male connector 100 is plugged in the female connector 200, the electrical circuit is conducted. In other words, the above-mentioned structure that the cathode plugs 130 are selectively in electrical contact with elastic element 150 is taken as a security mechanism for power interruption. Therefore, the structure is to make sure that only when the male connector 100 is plugged in the female connector 200 correctly, the power may be supplied.

Moreover, the security mechanism for power interruption in this embodiment is that the cathode plugs 130 are selectively in electrical contact with the elastic element 150, but the characteristic of this security mechanism for power interruption is not limited to the embodiment. For example, in some embodiments, the connector module 10 may not have this security mechanism for power interruption. That is to say, the male connector 100 may not include the elastic element 150, so the two power cords 160 are directly in electrical contact with the anode plugs 120 and the cathode plugs 130, respectively.

Furthermore, when the male connector 100 is inserted in the female connector 200, only the one anode plug 120 of the male connector 100 is inserted in the jack 212 of the female connector 200, and the shape of the ring-shaped sidewall 140 matches with the circular-column-projection shape of the female magnetic part 210. Therefore, when the male connector 100 is inserted in the female connector 200, the male connector 100 may be pivoted on the female connector 200 relatively. Moreover, the male connector 100 may be relatively rotated on the female connector 200 in all 360 degrees in a pivotal relation. In other words, the male connector 100 has the 360 degrees in one full rotation of plug-in direction in relative to the female connector 200.

The above-mentioned embodiment discloses the connector module and the male connector and the female connector thereof. The male magnetic part of the male connector attracts the female magnetic part of the female connector, and the male connector is inserted in the jack of the female connector by the only one anode plug, so that the male connector may be pivoted on the female connector in 360 degrees. In this way, the male connector has the 360 degrees in one full rotation of the plug-in direction in relative to the female connector so that it is convenient for the user to use the connector module and the male connector and the female connector thereof in any angle of plug-in-direction.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A connector module, comprising:

a female connector, comprising:

a female magnetic part, having a jack;

an anode contact, disposed in the jack; and a cathode contact, disposed on the female magnetic part and surrounding the jack; and a male connector, comprising:

a male magnetic part, corresponding to the female magnetic part;

an anode plug, disposed on and protruded from the male magnetic part; and at least one cathode plug, disposed on the male magnetic part, the at least one cathode plug being removably having a protruding position and an invaginating position in relative to the male magnetic part;

wherein the male magnetic part attracts the female magnetic part, the anode plug is inserted into the jack and in electrical contact with the anode contact, the at least one cathode plug is in electrical contact with the cathode contact and the at least one cathode plug is moved from the protruding position to the invaginating position, and the male connector is used for rotating on the female connector relatively.

2. The connector module according to claim 1, wherein the male connector further comprises a ring-shaped sidewall surrounding the male magnetic part, when the male magnetic part attracts the female magnetic part, the ring-shaped sidewall surrounds and covers the female magnetic part.

3. The connector module according to claim 1, wherein the shape of the female magnetic part is a circular column projection.

4. The connector module according to claim 1, wherein the female magnetic part further comprises an insulated layer surrounding the jack and disposed between the anode contact and the cathode contact.

5. The connector module according to claim 1, wherein the male connector comprises an elastic element connected to a power cord, when the at least one cathode plug is at the protruding position, the at least one cathode plug is kept a distance from the elastic element, and when the at least one cathode plug is at the invaginating position, the at least one cathode plug is in electrical contact with the elastic element.

6. The connector module according to claim 1, wherein the male connector comprises the plurality of cathode plugs surrounding the anode plug.

7. The connector module according to claim 1, wherein the material of the male magnetic part and the material of the female magnetic part both are permanent magnets.

8. The connector module according to claim 1, wherein the material of the female magnetic part is a permanent magnet and the material of the male magnetic part is a magnetic conductive material.

9. The connector module according to claim 1, wherein the material of the female magnetic part is a magnetic conductive material and the material of the male magnetic part is a permanent magnet.

10. A female connector, for pivoting on a male connector comprising a male magnetic part, an anode plug and a cathode plug, the female connector comprising:

a female magnetic part, corresponding to the male magnetic part and having a jack;

an anode contact, disposed in the jack and corresponding to the anode plug; and a cathode contact, disposed on the female magnetic part, surrounding the jack and corresponding to the cathode plug.

11. The female connector according to claim 10, wherein the shape of the female magnetic part is a circular column projection.

12. The female connector according to claim 10, wherein the female magnetic part further comprises an insulated layer surrounding the jack and disposed between the anode contact and the cathode contact.

13. The female connector according to claim 10, wherein the material of the female magnetic part is a permanent magnet.

14. The female connector according to claim 10, wherein the material of the female magnetic part is a magnetic conductive material.

15. A male connector, for pivoting on a female connector comprising a female magnetic part, an anode contact and a cathode contact, the male connector comprising:

a male magnetic part, corresponding to the female magnetic part;

an anode plug, disposed on and protruded from the male magnetic part and corresponding to the anode contact; and at least one cathode plug, disposed on the male magnetic part, the at least one cathode plug being removably having a protruding position and an invaginating position in relative to the male magnetic part and corresponding to the cathode contact.

16. The male connector according to claim 15, further comprises a ring-shaped sidewall surrounding the male magnetic part, when the male magnetic part attracts the female magnetic part, the ring-shaped sidewall surrounds and covers the female connector.

17. The male connector according to claim 15, wherein the male connector comprises an elastic element connected to a power cord, when the at least one cathode plug is at the protruding position, the at least one cathode plug is kept a distance from the elastic element, and when the at least one cathode plug is at the invaginating position, the at least one cathode plug is in electrical contact with the elastic element.

18. The male connector according to claim 15, further comprises the plurality of cathode plugs surrounding the anode plug.

19. The male connector according to claim 15, wherein the material of the male magnetic part is a magnetic conductive material.

20. The male connector according to claim 15, wherein the material of the male magnetic part is a permanent magnet.

* * * * *